US010718091B1

(12) United States Patent
Wesley

(10) Patent No.: US 10,718,091 B1
(45) Date of Patent: Jul. 21, 2020

(54) ILLUMINATED HEATED DRIVEWAY

(71) Applicant: Everett Wesley, Birmingham, AL (US)

(72) Inventor: Everett Wesley, Birmingham, AL (US)

( * ) Notice: Subject to any disclaimer, the term of this patent is extended or adjusted under 35 U.S.C. 154(b) by 0 days.

(21) Appl. No.: 16/174,408

(22) Filed: Oct. 30, 2018

(51) Int. Cl.

| | |
|---|---|
| ***E01C 9/00*** | (2006.01) |
| ***E01C 11/26*** | (2006.01) |
| ***E01C 17/00*** | (2006.01) |
| ***E01C 5/22*** | (2006.01) |
| ***F21V 23/06*** | (2006.01) |
| ***H05B 3/28*** | (2006.01) |
| ***F21V 33/00*** | (2006.01) |
| *F21Y 115/10* | (2016.01) |

(52) U.S. Cl.
CPC ..... *E01C 9/00* (2013.01); *E01C 5/22* (2013.01); *E01C 11/265* (2013.01); *E01C 17/00* (2013.01); *F21V 23/06* (2013.01); *F21V 33/006* (2013.01); *H05B 3/28* (2013.01); *E01C 2201/00* (2013.01); *F21Y 2115/10* (2016.08)

(58) Field of Classification Search
CPC ..... E01C 11/265; E01C 11/26; E01C 11/24; E01C 11/245; E01C 7/26; E01C 7/14; E01C 7/18; E01C 9/00; E01C 5/06; E01C 5/22; E01C 17/00; H05B 3/28
See application file for complete search history.

(56) References Cited

U.S. PATENT DOCUMENTS 3,445,628 A * 5/1969 Bateman, Sr. ..... F24D 13/024 392/436
4,340,929 A * 7/1982 Konikoff ..... E04B 5/46 362/153
4,967,057 A * 10/1990 Bayless ..... H05B 3/36 219/213
5,233,971 A 8/1993 Hanley
5,550,350 A * 8/1996 Barnes ..... E01C 11/265 219/213
D376,657 S 12/1996 Bohn
6,027,280 A 2/2000 Conners
6,051,811 A 4/2000 Hardison
6,082,886 A * 7/2000 Stanford ..... F21V 33/006 362/153.1
6,127,653 A * 10/2000 Samuels ..... E01C 11/265 219/213
6,211,493 B1 * 4/2001 Bouman ..... E01C 11/265 219/213

(Continued)

FOREIGN PATENT DOCUMENTS

WO 2012122569 4/2014

*Primary Examiner* — Abigail A Risic

(57) ABSTRACT

The illuminated heated driveway is an overlay panel that covers and heats a covered area exemplified by, but not limited to, a driveway or a sidewalk. Multiple overlay panels may be conjoined to cover an area larger than a single overlay panel. The overlay panels are powered by a power assembly that couples to a connector on one of the overlay panels. Additional connectors may electrically couple adjacent overlay panels. Within each overlay panel, a heating element and a lighting system is electrically connected to the power connectors. The heating element may melt wintry weather that accumulates on the panel and the lighting system may cause the panel to glow for improved visibility. The power assembly may comprise a time to turn the panel on and off throughout the day.

8 Claims, 6 Drawing Sheets

(56) References Cited

U.S. PATENT DOCUMENTS 6,278,085 B1 * 8/2001 Abukasm ..... E01C 11/265 219/213
6,715,956 B1 * 4/2004 Weber ..... E01C 5/20 404/18
6,909,074 B1 * 6/2005 Bradley ..... E01C 11/26 219/528
7,204,629 B2 4/2007 Pipo
8,672,578 B2 3/2014 Blocken
8,952,301 B2 * 2/2015 Naylor ..... A01G 13/06 219/548
9,169,607 B2 10/2015 Schweizer
2006/0191902 A1 * 8/2006 Naylor ..... E01C 11/265 219/528
2006/0191903 A1 * 8/2006 Naylor ..... E01C 11/265 219/528
2006/0231131 A1 10/2006 Hain
2006/0289468 A1 * 12/2006 Seibert ..... E01C 11/265 219/528
2007/0102243 A1 * 5/2007 Ruminski ..... E01C 5/20 182/222
2008/0201874 A1 * 8/2008 Coyle ..... E01C 5/20 14/71.1
2009/0050617 A1 * 2/2009 Paris ..... E01C 11/265 219/213
2009/0056244 A1 * 3/2009 Caterina ..... A01G 13/06 52/169.11
2009/0297132 A1 * 12/2009 Abbott ..... B32B 7/02 392/407
2013/0119043 A1 * 5/2013 Consiglio ..... E01C 11/265 219/213
2016/0084986 A1 * 3/2016 Zach ..... E04D 13/103 219/502
2016/0230354 A1 * 8/2016 Theodore, Jr. ..... E04C 2/525
2016/0355997 A1 * 12/2016 Lewley ..... E01C 11/26
2017/0191228 A1 * 7/2017 Dong ..... E01C 11/265
2017/0211241 A1 * 7/2017 Calinescu ..... E01C 5/005
2017/0335523 A1 * 11/2017 Moussa ..... E01C 11/265
2018/0087225 A1 3/2018 McNeeley
2018/0102730 A1 * 4/2018 Brusaw ..... G08G 1/0116
2018/0187380 A1 * 7/2018 Naylor ..... E01C 11/265
2019/0048533 A1 * 2/2019 Anthony ..... E01C 11/26
2019/0090313 A1 * 3/2019 Jones, Sr. ..... H05B 3/22

* cited by examiner

ILLUMINATED HEATED DRIVEWAY

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of outdoor safety, more specifically, an illuminated heated driveway.

SUMMARY OF INVENTION

The illuminated heated driveway is an overlay panel that covers and heats a covered area exemplified by, but not limited to, a driveway or a sidewalk. Multiple overlay panels may be conjoined to cover an area larger than a single overlay panel. The overlay panels are powered by a power assembly that couples to a connector on one of the overlay panels. Additional connectors may electrically couple adjacent overlay panels. Within each overlay panel, a heating element and a lighting system is electrically connected to the power connectors. The heating element may melt wintry weather that accumulates on the panel and the lighting system may cause the panel to glow for improved visibility. The power assembly may comprise a time to turn the panel on and off throughout the day. The surface of the panel may be non-slip.

An object of the invention is to cover an area with a panel having a non-slip surface.

Another object of the invention is to provide a heating element within the panel to melt wintry accumulation on the panel.

A further object of the invention is to provide a lighting system within the panel to improve the visibility of the panel.

Yet another object of the invention is to electrically power the panel through a timer and to electrically interconnect adjacent panels.

These together with additional objects, features and advantages of the illuminated heated driveway will be readily apparent to those of ordinary skill in the art upon reading the following detailed description of the presently preferred, but nonetheless illustrative, embodiments when taken in conjunction with the accompanying drawings.

In this respect, before explaining the current embodiments of the illuminated heated driveway in detail, it is to be understood that the illuminated heated driveway is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the illuminated heated driveway.

It is therefore important that the claims be regarded as including such equivalent construction insofar as they do not depart from the spirit and scope of the illuminated heated driveway. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
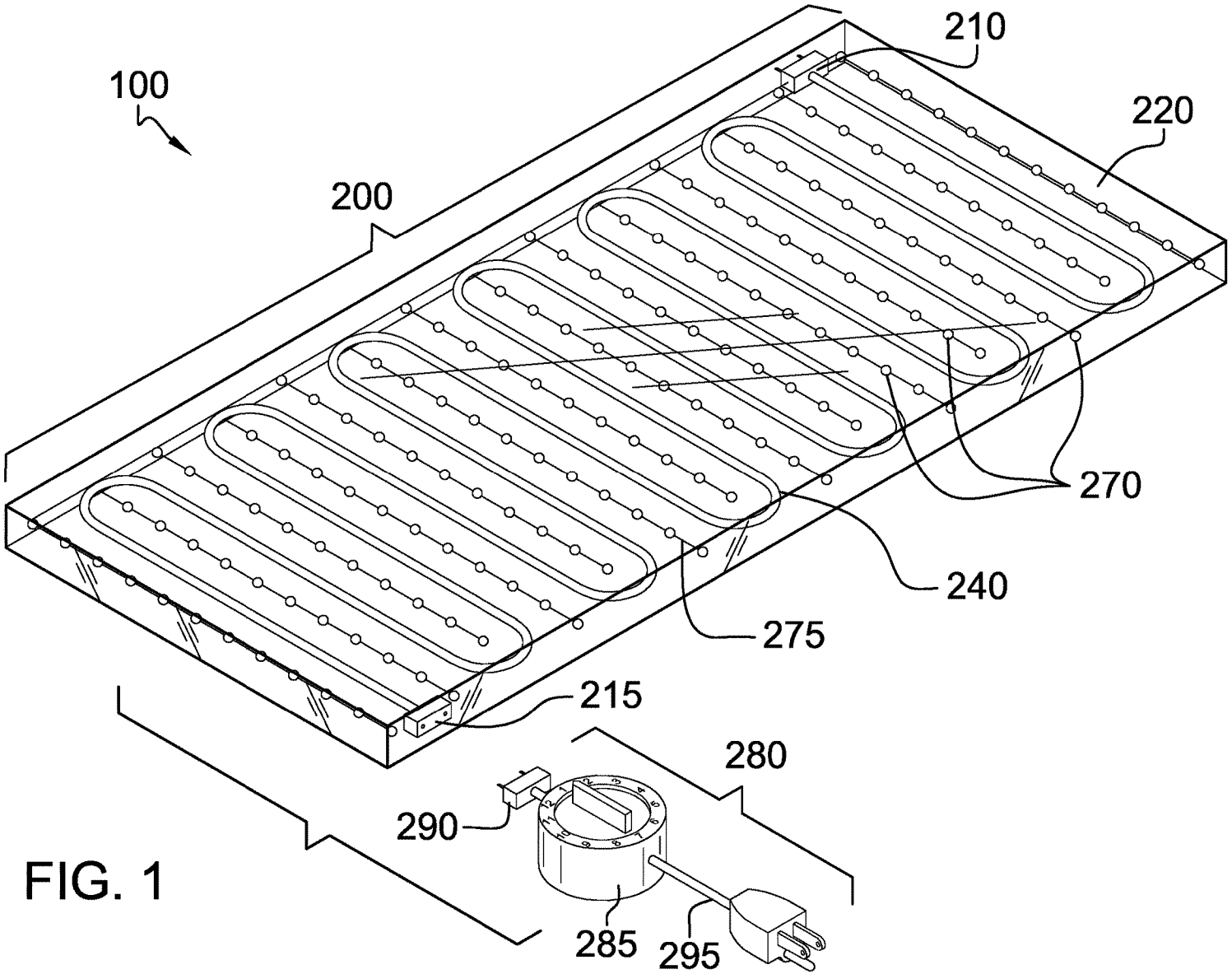
FIG. 1 is a perspective view of an embodiment of the disclosure.
Figure 2:
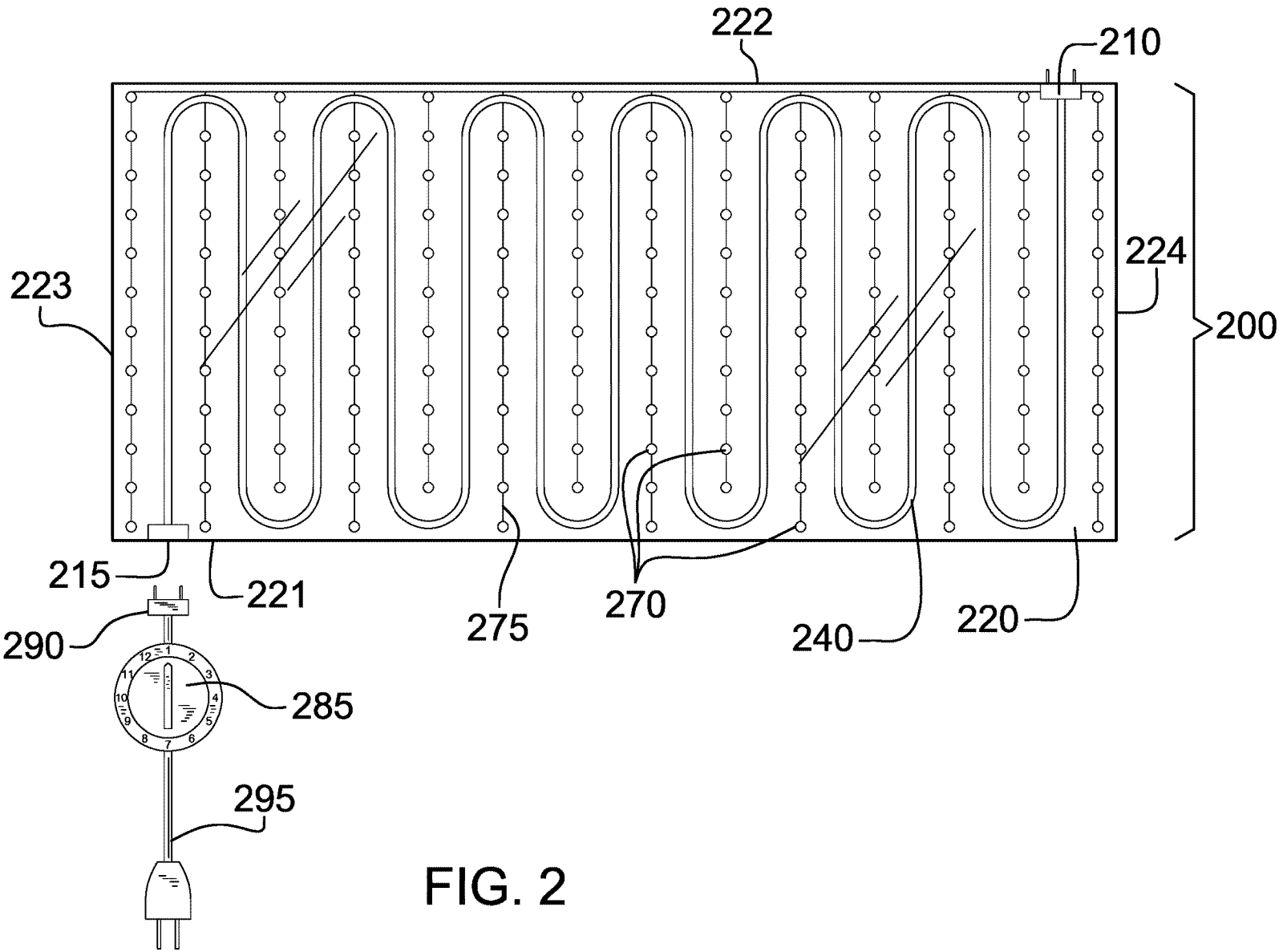
FIG. 2 is a top view of an embodiment of the disclosure.
Figure 3:
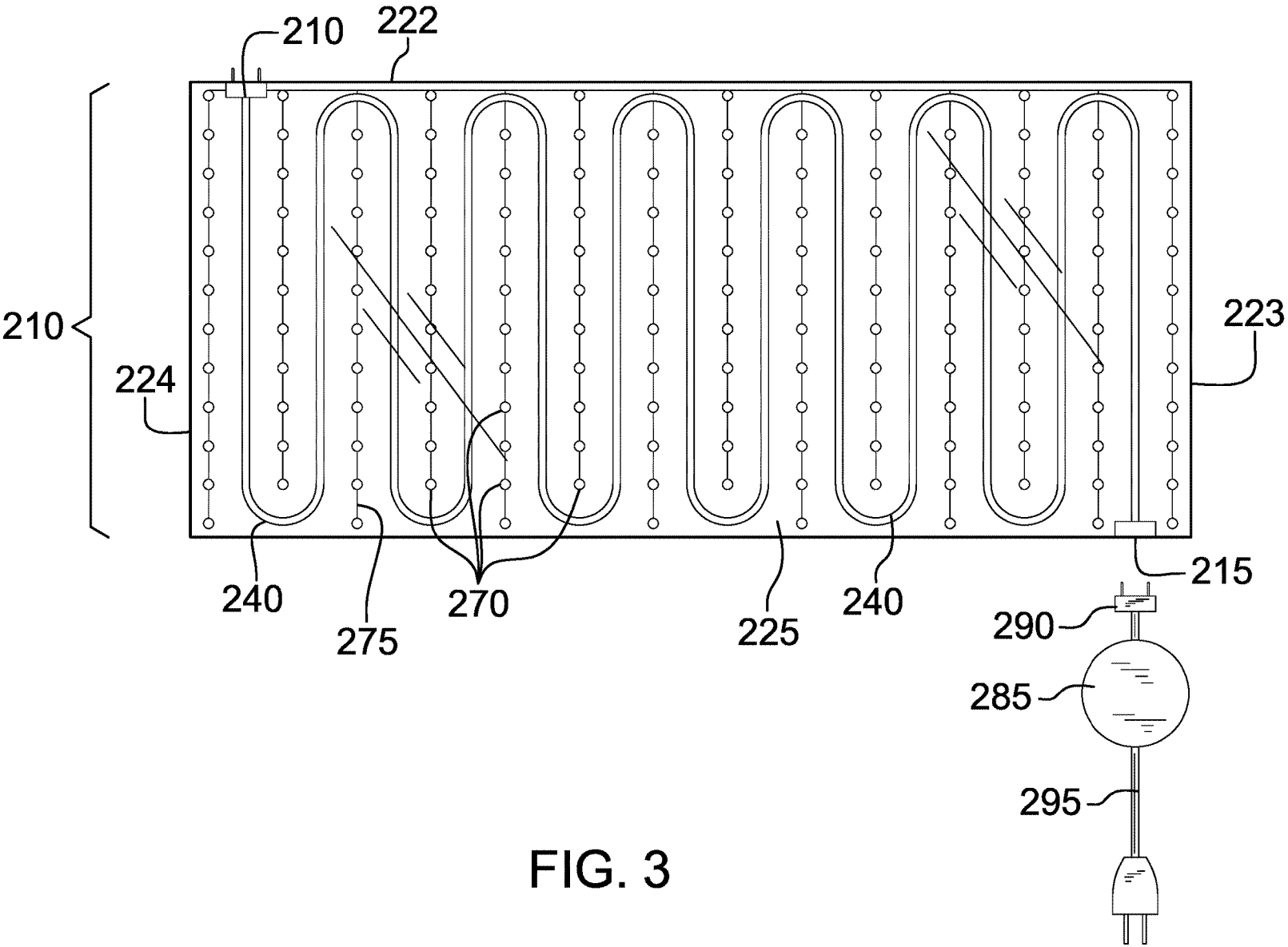
FIG. 3 is a bottom view of an embodiment of the disclosure.
Figure 4:
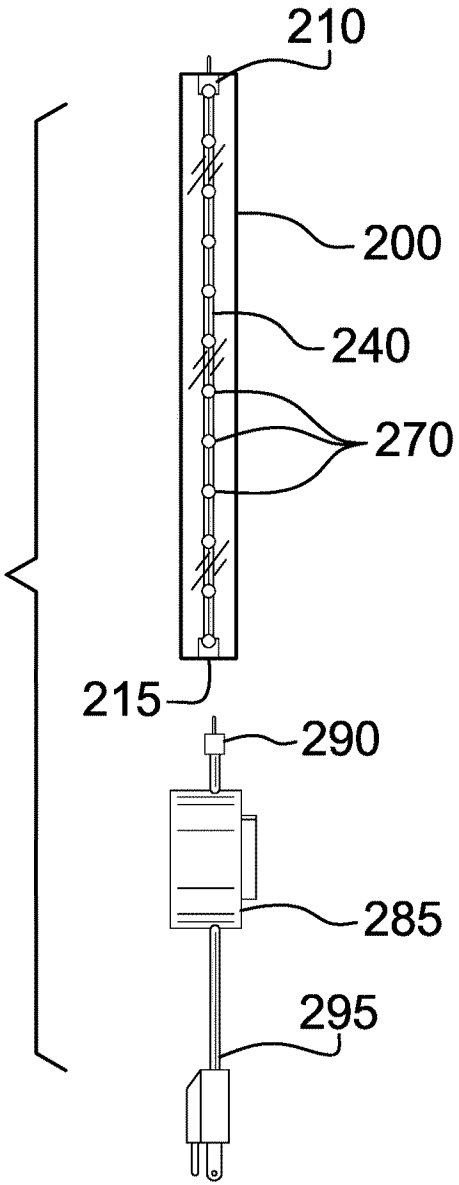
FIG. 4 is a side view of an embodiment of the disclosure.
Figure 5:
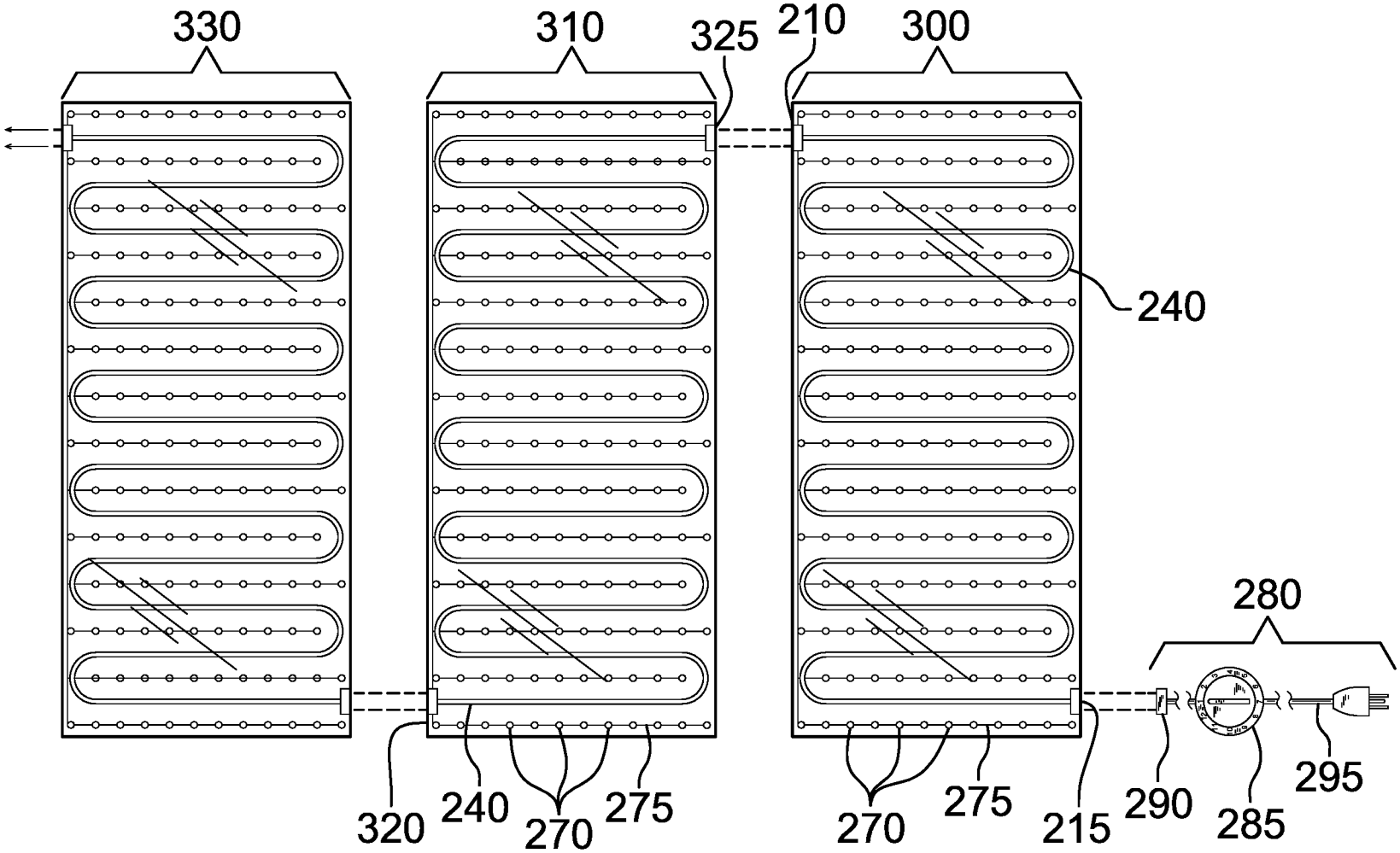
FIG. 5 is an exploded in-use view of an embodiment of the disclosure illustrating three interconnected overlay panels.
Figure 6:
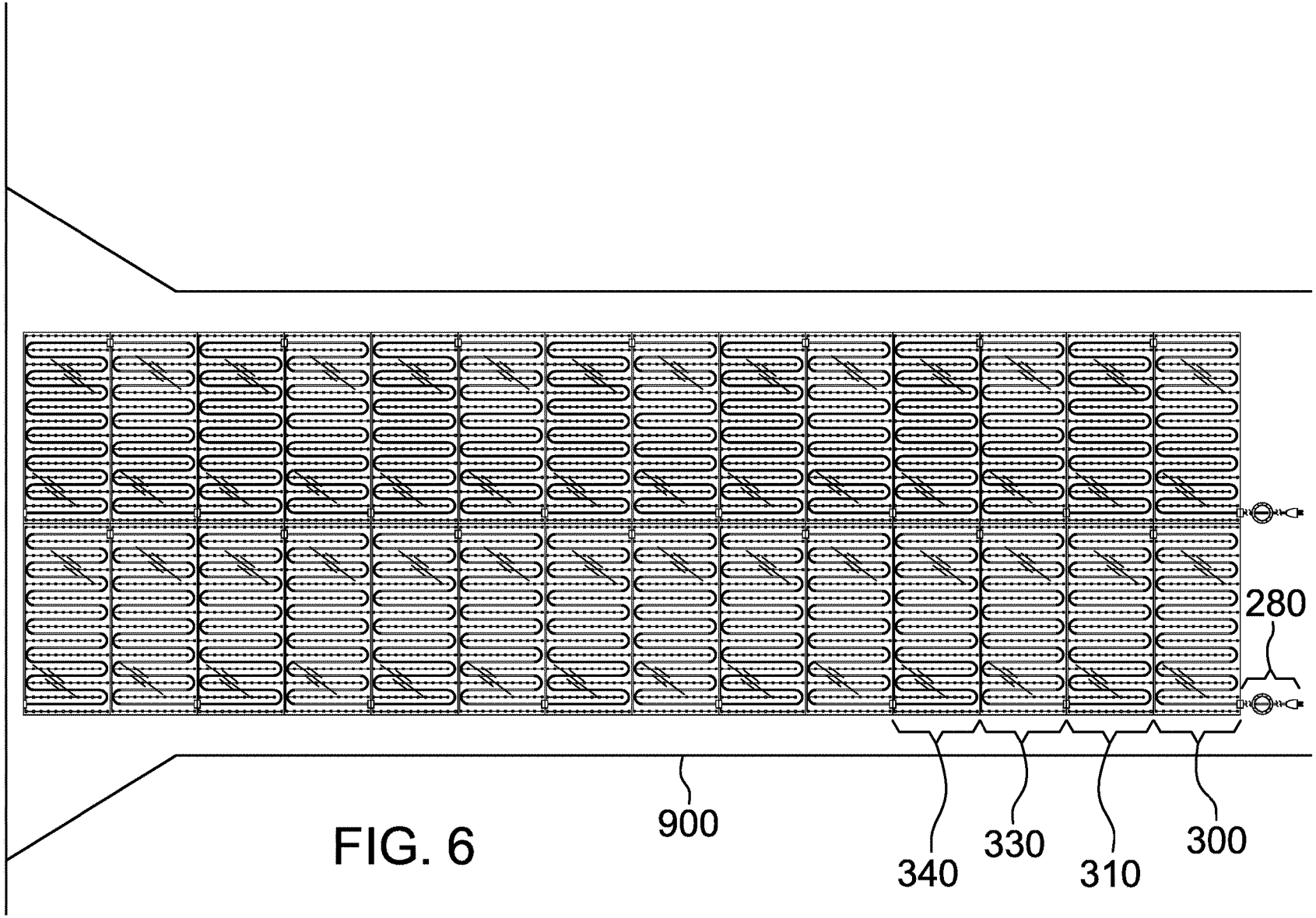
FIG. 6 is an in-use view of an embodiment of the disclosure illustrating a driveway covered by a plurality of interconnected overlay panels.

Detailed reference will now be made to a first potential embodiment of the disclosure, which is illustrated in FIGS. 1 through 6.

The illuminated heated driveway 100 (hereinafter invention) comprises an overlay panel 200 and a power assembly 280. The overlay panel 200 covers a surface and heats and illuminates the surface. A plurality of the overlay panels 200 may be used in conjunction with each other to heat and illuminate a covered area that is larger than the overlay panel 200. As non-limiting examples, the surface may be a driveway 900 or a sidewalk.

The overlay panel 200 may be a right rectangular prism which encloses a heating element 240 and a lighting system. The overlay panel 200 comprise a top surface 220, a bottom surface 225, a first lateral side 221, a second lateral side 222, a third lateral side 223, and a fourth lateral side 224. The overlay panel 200 may be made from a transparent or translucent material.

The overlay panel 200 may comprise a first female power connector 215 to receive electrical power from the power assembly 280. The first female power connector 215 may be located on the first lateral side 221.

The overlay panel 200 may comprise a first male power connector 210. The first male power connector 210 may be located on the second lateral side 222.

In some embodiments, the first lateral side 221 and the second lateral side 222 may be opposing side of the overlay panel 200. In some embodiments, the first male power connector 210 and the first female power connector 215 may be at opposite ends of their respective sides such that if a first panel 300 is placed adjacent to a second panel 310 and the second panel 310 is flipped end-over-end then the first male power connector 210 on the first panel 300 aligns with the first female power connector 215 on the second panel 310.

The first male power connector 210 may be electrically coupled within the overlay panel 200 to the first female power connector 215 such that the first panel 300 may pass the electrical power to the second panel 310.

The overlay panels 200 may be coupled to each other to cover the covered area. The overlay panels 200 may be electrically interconnected by flipping every other panel end-over-end such that the first female power connector 215 of a flipped panel remains on the same lateral side and moves to the opposite longitudinal end.

The first panel 300 may be aligned at a corner of the covered area. The second panel 310 may be positioned adjacent to the first panel 300 with the second panel 310 flipped end-over-end such that a second female power connector 325 on the second panel 310 aligns and mates with the first male power connector 210 on the first panel 300. A second male power connector 320 on the second panel 310 may couple to a third panel 330. The third panel 330 and a fourth panel 340 may be oriented the same as the first panel 300 and the second panel 310 and may extend coverage of the covered area. The pattern may repeat with additional panels added adjacent to the previously placed panels. A third male power connector 290 on the power assembly 280 may be coupled to the first female power connector 215 on the first panel 300.

The top surface 220 and the bottom surface 225 of the overlay panel 200 may comprise a non-slip surface. As non-limiting examples, the top surface 220 and the bottom surface 225 may be routed, milled, sanded, chemically etched, or may have appliques applied such that the top surface 220 and the bottom surface 225 present a surface that reduces slipping.

The lighting system comprises a plurality of LEDs 270 and LED wiring 275. The plurality of LEDs 270 may be distributed through the interior of the overlay panel 200. The LED wiring 275 may electrically interconnect the plurality of LEDs 270 and may electrically connect the plurality of LEDs 270 to the first female power connector 215. The plurality of LEDs 270 may illuminate when the electrical power is applied to the first female power connector 215. The overlay panel 200 may glow when the plurality of LEDs 270 are illuminated.

The heating element 240 may be resistive wiring that converts electrical energy into heat. The heating element 240 may be routed throughout the overlay panel 200 such that the heat produced by the heating element 240 reaches all areas of the top surface 220 and the bottom surface 225. As a non-limiting example, the heating element 240 may follow a serpentine path through the overlay panel 200.

The power assembly 280 may comprise the third male power connector 290, a timer 285, and an AC line cord 295. The power assembly 280 may control the application of the electrical power to the overlay panel 200.

The third male power connector 290 may electrically couple to the first female power connector 215 on the overlay panel 200. The third male power connector 290 may apply the electrical power to the overlay panel 200. The third male power connector 290 may be coupled to the timer 285 via an electrical cord.

The timer 285 may apply the electrical power to the overlay panel 200 or may remove the electrical power from the overlay panel 200 according to a schedule established by the timer 285. The schedule may include an on state that passes the electrical power from the AC line cord 295 to the third male power connector 290. The schedule may include an off state that blocks the electrical power from the AC line cord 295 from reaching the third male power connector 290.

The AC line cord 295 may plug into a wall outlet via a 2-proing or 3-prong AC plug and may provide the electrical power to the timer 285.

In use, the first panel 300 is positioned at a corner of the covered area. The second panel 310 is position adjacent to the first panel 300, flipped end-over-end, and mated with the first panel 300 by interconnecting the first male power connector 210 on the first panel 300 to the second female power connector 325 on the second panel 310. The third panel 330 may be placed adjacent to the second panel 310 using the same orientation as the first panel 300 and the third panel 330 may be mated with the second panel 310. The fourth panel 340 may be placed adjacent to the third panel 330 using the same orientation as the second panel 310 and the fourth panel 340 may be mated with the third panel 330. Additional panels may be placed and mated following the same pattern of flipping every other panel end-over-end and then mating adjacent panels. If the covered area is wider than the overlay panel 200, more panels may be placed adjacent to the longitudinal edges of the original set of the overlay panels 200 to create a horizontal matrix of panels. The power assembly 280 is connected by plugging the third male power connector 290 of the power assembly 280 to the first female power connector 215 on the first panel 300 and by plugging the AC line cord 295 into the wall outlet. The timer 285 may then be programmed to establish time periods for the on state and for the off state.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, "AC" is an acronym for alternating current.

As used herein, the words "couple", "couples", "coupled" or "coupling", refer to connecting, either directly or indirectly, and does not necessarily imply a mechanical connection.

As used in this disclosure, a "heating element" is a resistive wire that is used to convert electrical energy into heat. As non-limiting examples, common metals used to form heating elements include a combination of nickel and chromium, a combination of iron, chromium and aluminum, a combination of copper, nickel, iron, and manganese, or platinum.

As used in this disclosure, "horizontal" is a directional term that refers to a direction that is perpendicular to the local force of gravity. Unless specifically noted in this disclosure, the horizontal direction is always perpendicular to the vertical direction.

As used in this disclosure, the word "interior" is used as a relational term that implies that an object is located or contained within the boundary of a structure or a space.

As used in this disclosure, the word "lateral" refers to the sides of an object or movement towards a side. Lateral directions are generally perpendicular to longitudinal directions. "Laterally" refers to movement in a lateral direction.

As used in this disclosure, an "LED" is an acronym for a light emitting diode. An LED allows current to flow in one direction and when current is flowing the LED emits photons. The wavelength of the light that is emitted may be in the visible range of the spectrum or may extend into either the infrared (IR) spectral range or the ultraviolet (UV) spectral range. The brightness of the LED can be increased and decreased by controlling the amount of current flowing through the LED. Multiple LEDs having different emission spectrums may be packaged into a single device to produce a multi-color LED. A broad range of colors may be produced by multi-color LEDs by selecting which of the multiple LEDs are energized and by controlling the brightness of each of the multiple LEDs. Organic LEDs (OLEDs) are included in this definition.

As used herein, the word "longitudinal" or "longitudinally" refers to a lengthwise or longest direction.

As used herein, a "longitudinal edge" or "longitudinal end" is an edge or end that is reached when traversing an object in a longitudinal direction.

As used herein, "mate" refers to coupling at a predefined interface.

As used in this disclosure, "orientation" refers to the positioning and/or angular alignment of a first object relative to a second object or relative to a reference position or reference direction.

As used in this disclosure, an "outlet" is a device placed in the electrical wiring system of a building where electrical current can be taken to run electrical devices. In this disclosure, an outlet is a socket adapted to receive a plug. In some embodiments, an outlet may find use in a vehicle or on equipment. As non-limiting examples, outlets may be used on recreational vehicles and on generators.

As used in this disclosure, a "plug" is an electrical termination that electrically connects a first electrical circuit to a second electrical circuit or a source of electricity.

As used in this disclosure, a "prism" is a 3 dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called that lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous the center axis of a cylinder. A prism wherein the ends are circles is commonly referred to as a cylinder.

As used herein, "serpentine" refers to an object or line that moves or lies along a winding or meandering path.

As used in this disclosure, "translucent" refers to a material that allows light to pass through the material but that significantly scatters the light such that an object cannot be clearly seen through the material.

As used in this disclosure, "transparent" refers to a material that allows light to pass through the material without significant scattering such that an object can be clearly seen through the material.

Throughout this document references to "wire", "wires", "wired", or "wiring" may describe and/or show a single conductor when, in fact, two conductors may be required to power or control a subsystem; a convention used herein is to not show the common return conductor to which all electrical subsystems are connected—this common return conductor is a continuous electrical path and does not pass through any type of switch or other electrical component other than the possibility of passing through one or more connectors.

With respect to the above description, it is to be realized that the optimum dimensional relationship for the various components of the invention described above and in FIGS. 1 through 6, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A illuminated heated driveway comprising:

an overlay panel and a power assembly;

wherein the overlay panel covers a surface and heats and illuminates the surface;

wherein a plurality of the overlay panels used in conjunction with each other heat and illuminate a covered area that is larger than the overlay panel;

wherein the overlay panel is a right rectangular prism which encloses a heating element and a lighting system;

wherein the overlay panel comprise a top surface, a bottom surface, a first lateral side, a second lateral side, a third lateral side, and a fourth lateral side;

wherein the overlay panel comprises a first female power connector to receive electrical power from the power assembly;

wherein the first female power connector is located on the first lateral side;

wherein the overlay panel comprises a first male power connector;

wherein the first male power connector is located on the second lateral side;

wherein the first lateral side and the second lateral side are opposing side of the overlay panel;

wherein the first male power connector and the first female power connector are at opposite ends of their respective sides such that if a first panel is placed adjacent to a second panel and the second panel is flipped end-over-end then the first male power connector on the first panel aligns with the first female power connector on the second panel;

wherein the top surface and the bottom surface of the overlay panel comprise a non-slip surface;

wherein the heating element is resistive wiring that converts electrical energy into heat;

wherein the heating element is routed throughout the overlay panel such that the heat produced by the heating element reaches all areas of the top surface and the bottom surface;

wherein the first male power connector is electrically coupled within the overlay panel to the first female power connector such that the first panel passes the electrical power to the second panel;

wherein the overlay panels are coupled to each other to cover the covered area;

wherein the overlay panels are electrically interconnected by flipping every other panel end-over-end such that the first female power connector of a flipped panel remains on the same lateral side and moves to the opposite longitudinal end;

wherein the first panel is aligned at a corner of the covered area;

wherein the second panel is positioned adjacent to the first panel with the second panel flipped end-over-end such that a second female power connector on the second panel aligns and mates with the first male power connector on the first panel;

wherein a second male power connector on the second panel couples to a third panel;

wherein the third panel and a fourth panel are oriented the same as the first panel and the second panel and extend coverage of the covered area;

wherein the pattern repeats with additional panels added adjacent to the previously placed panels;

wherein a third male power connector on the power assembly is coupled to the first female power connector on the first panel;

wherein the power assembly comprises the third male power connector, a timer, and an AC line cord;

wherein the power assembly controls the application of the electrical power to the overlay panel.

2. The illuminated heated driveway according to claim 1 wherein the overlay panel is made from a transparent or translucent material.

3. The illuminated heated driveway according to claim 1 wherein the lighting system comprises a plurality of LEDs and LED wiring;

wherein the plurality of LEDs is distributed through the interior of the overlay panel;

wherein the LED wiring electrically interconnects the plurality of LEDs and electrically connects the plurality of LEDs to the first female power connector.

4. The illuminated heated driveway according to claim 3 wherein the plurality of LEDs illuminate when the electrical power is applied to the first female power connector;

wherein the overlay panel glows when the plurality of LEDs are illuminated.

5. The illuminated heated driveway according to claim 1 wherein the heating element follows a serpentine path through the overlay panel.

6. The illuminated heated driveway according to claim 5 wherein the third male power connector electrically couples to the first female power connector on the overlay panel;

wherein the third male power connector applies the electrical power to the overlay panel;

wherein the third male power connector is coupled to the timer via an electrical cord.

7. The illuminated heated driveway according to claim 6 wherein the timer applies the electrical power to the overlay panel or removes the electrical power from the overlay panel according to a schedule established by the timer;

wherein the schedule includes an on state that passes the electrical power from the AC line cord to the third male power connector;

wherein the schedule includes an off state that blocks the electrical power from the AC line cord from reaching the third male power connector.

8. The illuminated heated driveway according to claim 7 wherein the AC line cord plugs into a wall outlet via a 2-proing or 3-prong AC plug and provides the electrical power to the timer.

* * * * *